US007597563B2

(12) United States Patent
Shinkawa et al.

(10) Patent No.: US 7,597,563 B2
(45) Date of Patent: Oct. 6, 2009

(54) CONDUCTING MEMBER AND CONNECTOR HAVING CONDUCTING MEMBER

(75) Inventors: Daisuke Shinkawa, Makinohara (JP); Toru Yamaguchi, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/245,011

(22) Filed: Oct. 3, 2008

(65) Prior Publication Data

US 2009/0093170 A1 Apr. 9, 2009

(30) Foreign Application Priority Data

Oct. 5, 2007 (JP) ..... 2007-261957

(51) Int. Cl.
*H01R 13/648* (2006.01)

(52) U.S. Cl. ..... 439/98

(58) Field of Classification Search ..... 439/95, 439/98, 99, 108, 582
See application file for complete search history.

(56) References Cited

U.S. PATENT DOCUMENTS 5,429,529 A * 7/1995 Hashizawa et al. ..... 439/607.5
5,618,190 A * 4/1997 Masuda et al. ..... 439/98
5,618,198 A * 4/1997 Sato et al. ..... 439/274
5,662,495 A * 9/1997 Inaba et al. ..... 439/607.41
5,823,805 A * 10/1998 Weihing et al. ..... 439/108
5,911,599 A * 6/1999 Masuda ..... 439/607.58
6,171,150 B1 * 1/2001 Saito et al. ..... 439/607.51
6,210,223 B1 * 4/2001 Aoyama et al. ..... 439/585
6,257,931 B1 * 7/2001 Sakurai et al. ..... 439/607.5
6,270,377 B1 * 8/2001 Miyazaki et al. ..... 439/607.41
6,384,335 B1 * 5/2002 Saito et al. ..... 174/74 R
6,491,530 B2 * 12/2002 Koide et al. ..... 439/92
6,533,615 B2 * 3/2003 Koide et al. ..... 439/607.48
6,554,623 B2 * 4/2003 Yoshioka ..... 439/98
6,702,611 B1 * 3/2004 Miyazaki et al. ..... 439/559
6,709,290 B2 * 3/2004 Yoshida ..... 439/585
6,749,464 B2 * 6/2004 Obata ..... 439/607.41
6,796,838 B2 * 9/2004 Yoshioka ..... 439/607.01
6,887,106 B2 * 5/2005 Noguchi et al. ..... 439/607.56
6,948,977 B1 * 9/2005 Behrent ..... 439/581
7,081,016 B2 * 7/2006 Tateno ..... 439/585
7,204,716 B1 * 4/2007 George et al. ..... 439/607.41
7,390,979 B1 * 6/2008 Johnson ..... 174/655
7,485,002 B2 * 2/2009 Nishide et al. ..... 439/607.17
7,488,211 B2 * 2/2009 Yamaoka ..... 439/595
2002/0042228 A1 * 4/2002 Yoshioka ..... 439/610
2002/0106917 A1 * 8/2002 Koide et al. ..... 439/92

(Continued)

FOREIGN PATENT DOCUMENTS

JP 2003-133005 A 5/2003

*Primary Examiner*—Ross N Gushi
(74) *Attorney, Agent, or Firm*—Sughrue Mion, PLLC

(57) ABSTRACT

A connector includes a ground terminal connected to a braid shield of a coaxial cable at an end portion thereof, a housing receiving the ground terminal therein, and an earth plate for connecting the ground terminal to a mating member of a conductive nature provided outside the housing. The earth plate is formed by pressing a single metal sheet into a predetermined shape, and includes a housing retaining portion for being retainingly mounted on the housing, a terminal retaining/connecting portion for being engaged with the ground terminal to retain the ground terminal within the housing and also to be electrically connected to the ground terminal, and a grounding portion for electrical connection to the mating member.

6 Claims, 4 Drawing Sheets

U.S. PATENT DOCUMENTS

2005/0070158 A1* 3/2005 Tateno ..... 439/581
2006/0079130 A1* 4/2006 Zhang et al. ..... 439/607
2008/0119087 A1* 5/2008 Nishide et al. ..... 439/607

* cited by examiner

CONDUCTING MEMBER AND CONNECTOR HAVING CONDUCTING MEMBER

BACKGROUND OF THE INVENTION

1. Field of the Invention

This invention relates to a conducting member for connecting a terminal (received within a housing of a connector) to a mating member of a conductive nature provided outside the housing, and also relates to a connector having this conducting member.

2. Related Art

Wire harnesses are installed on an automobile so as to feed electric power and control signals to electronic equipments mounted on the automobile. Such a wire harness comprises a plurality of wires, and connectors connected to ends of these wires. The connector includes a conductive metal terminal connected to the wire, and an insulative housing receiving this metal terminal therein, and is connected to a connector of the electronic equipment.

One known example of the above connectors is a grounding-purpose connector for connecting the wire to a suitable grounding portion (for example, a body of the vehicle serving as a mating member) so as to protect the apparatus and to eliminate noise (see, for example, JP-A-2003-133005).

For example, as shown in FIGS. 13 and 14 of JP-A-2003-133005, the grounding-purpose connector comprises a ground terminal connected to an end portion of a wire, an insulative housing receiving this ground terminal therein, a conductive shell provided outside the housing and connected to a suitable grounding portion, an earth metal member for connecting the ground terminal to the shell, a screw for fixing this earth metal member, etc.

In the above conventional grounding-purpose connector, in order to connect the ground terminal to the grounding portion (that is, to the ground), several parts (that is, the shell, the earth metal member, the screw, etc.,) must be interposed therebetween, and therefore the number of the component parts increases, which has invited a problem that the time and labor required for assembling the connector increases. Another problem is that it is difficult to achieve a compact design of this connector because of the increased number of the component parts.

These problems are not limited to the above grounding-purpose connector, and are also encountered, for example, with the type of connector in which a terminal connected to an end portion of a wire and received within a housing is connected to a mating member (such as a printed circuit board) provided outside the housing via a conducting member.

SUMMARY OF THE INVENTION

It is therefore an object of this invention to provide a conducting member which can reduce the number of component parts of a connector, and can achieve a compact design of the connector. Another object is to provide a connector having this conducting member.

The above object has been achieved by a conducting member of the first aspect of the invention adapted to connect a terminal received within a housing of a connector to a mating member of a conductive nature provided outside the housing; wherein the conducting member is formed by pressing a single metal sheet into a predetermined shape, and includes a housing retaining portion for being retainingly mounted on the housing, a first connecting portion for being engaged with the terminal to retain the terminal within the housing and also to be electrically connected to the terminal, and a second connecting portion for electrical connection to the mating member.

A conducting member of the second aspect of the invention is characterized in that at least one of the first connecting portion and the second connecting portion is bent into an upwardly protruding shape to provide a spring portion for resiliently contacting the terminal or the mating member.

A conducting member of the third aspect of the invention is characterized in that the metal sheet is bent into a U-shape to provide the housing retaining portion, and the housing retaining portion includes a pair of opposed plate-like portions for holding an outer wall of the housing therebetween, and retaining holes formed respectively in the pair of plate-like portions and adapted to be fitted respectively on convex portions formed on the outer wall.

A conducting member of the fourth aspect of the invention is characterized in that the first connecting portion includes an engagement portion for being engaged with an edge portion of an opening formed through an outer wall of the terminal, and a closure portion for closing the opening.

A connector of the fifth aspect of the invention comprises a terminal connected to an end portion of a wire, a synthetic resin-made housing receiving the terminal therein, and a conducting member for connecting the terminal to a mating member of a conductive nature provided outside the housing, and is characterized in that the conducting member is a conducting member as defined in any one of the first to fourth aspects of the invention.

A connector of the sixth aspect of the invention is characterized in that the wire is a coaxial cable comprising a core wire, an insulative coating layer covering the core wire, a braid shield covering the insulative coating layer, and a sheath covering the braid shield; and the terminal is a ground terminal connected to the braid shield; and the conducting member is an earth plate for electrically connecting the braid shield to the mating member via the terminal for grounding purposes.

In the first aspect of the invention, the conducting member for connecting the terminal received within the housing to the mating member of the conductive nature provided outside the housing is formed by pressing the single metal sheet into the predetermined shape, and includes the housing retaining portion for being retainingly mounted on the housing, the first connecting portion for being engaged with the terminal to retain the terminal within the housing and also to be electrically connected to the terminal, and the second connecting portion for electrical connection to the mating member. Therefore, the terminal can be connected to the mating member, using only this conducting member, and therefore the number of the component parts can be reduced, and a compact design of the connector can be achieved. Furthermore, the first connecting portion serving also as a lance for holding the terminal within the housing is made of metal which is higher in strength than a synthetic resin, and therefore is less liable to be shaved and plastically deformed, and therefore this first connecting portion, while positively holding the terminal, can be electrically connected to this terminal.

In the second aspect of the invention, at least one of the first connecting portion and the second connecting portion is bent into the upwardly protruding shape to provide the spring portion for resiliently contacting the terminal or the mating member, and therefore either the terminal and the first connecting portion or the mating member and the second connecting portion can be positively connected together with a high contact pressure. Thus, the connecting reliability of the connector can be enhanced by using only this conducting member without using any other part such as a spring.

In the third aspect of the invention, the metal sheet is bent into the U-shape to provide the housing retaining portion, and the housing retaining portion includes the pair of opposed plate-like portions for holding the outer wall of the housing therebetween, and the retaining holes formed respectively in the pair of plate-like portions and adapted to be fitted respectively on the convex portions formed on the outer wall. Therefore, this conducting member can be easily mounted on the housing without using a jig and a screw.

In the fourth aspect of the invention, the first connecting portion includes the engagement portion for being engaged with the edge portion of the opening formed through the outer wall of the terminal, and the closure portion for closing the opening. Therefore, even when the impedance of that portion of the terminal in which the opening is formed is higher than the impedance of the other portion, the impedance of this portion (having the opening) can be made equal to the impedance of the other portion by closing the opening by the closure portion.

In the fifth aspect of the invention, the connector comprises the terminal connected to the end portion of the wire, the synthetic resin-made housing receiving the terminal therein, and the conducting member for connecting the terminal to the mating member of the conductive nature provided outside the housing, and the conducting member is a conducting member as defined in any one of the first to fourth aspects of the invention. Therefore, there can be provided the connector which has a reduced number of component parts, and is compact in size.

In the sixth aspect of the invention, the wire is the coaxial cable comprising the core wire, the insulative coating layer covering the core wire, the braid shield covering the insulative coating layer, and the sheath covering the braid shield, and the terminal is the ground terminal connected to the braid shield, and the conducting member is the earth plate for electrically connecting the braid shield to the mating member via the terminal for grounding purposes. Therefore, there can be provided the connector which has the noise elimination function and the reduced number of component parts and is compact in size.

DETAILED DESCRIPTION OF THE PREFERRED EMBODIMENTS

First Embodiment

Figure 1:
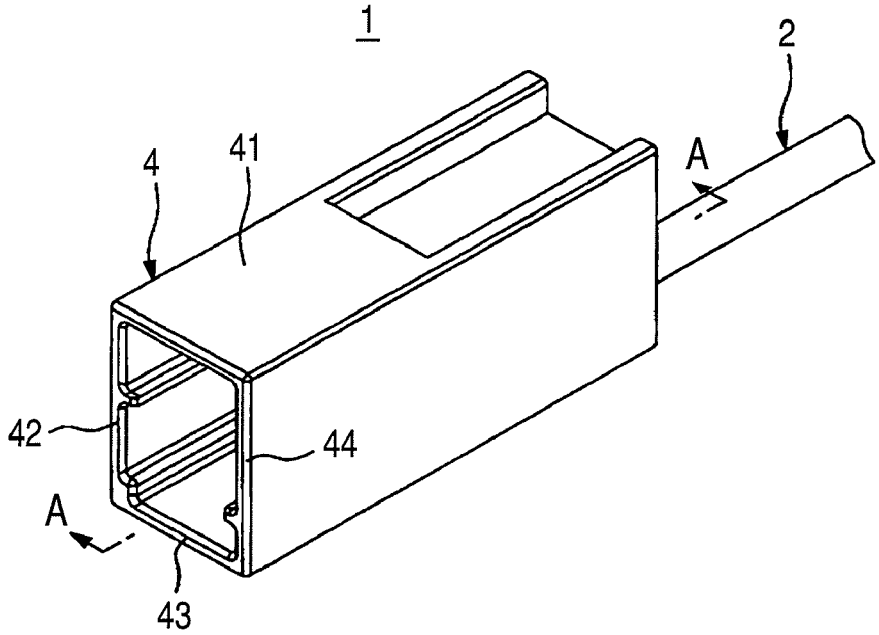
FIG. 1 is a perspective view of a first embodiment of a connector of the present invention.
Figure 2:
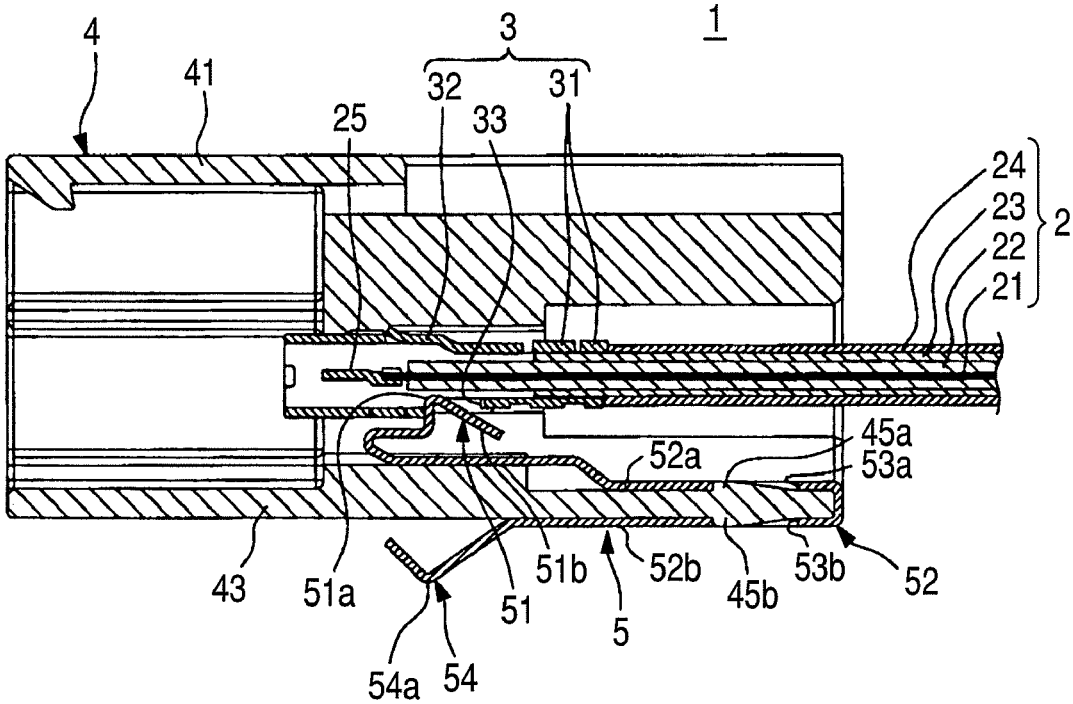
FIG. 2 is a cross-sectional view taken along the line A-A of FIG. 1.
Figure 3:
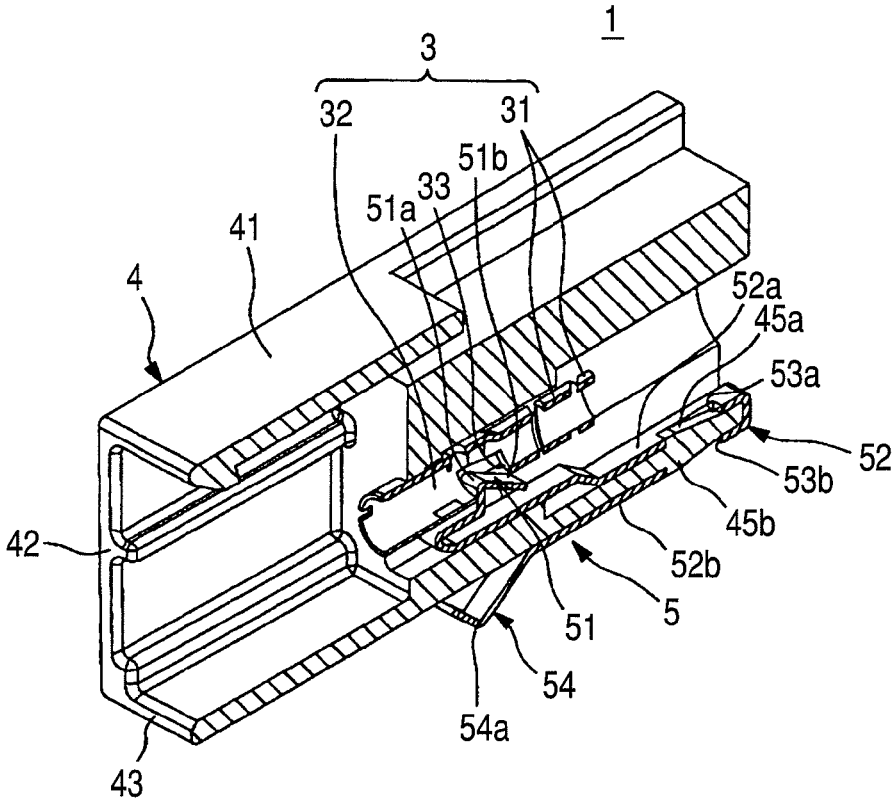
FIG. 3 is a cross-sectional, perspective view taken along the line A-A of FIG. 1.
Figure 4:
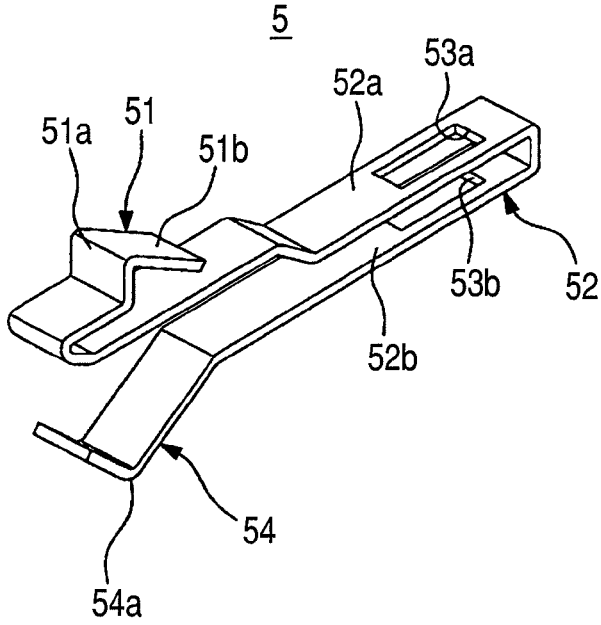
FIG. 4 is a perspective view showing a conducting member of the connector of FIG. 2.

A first embodiment of a connector of the present invention will now be described with reference to FIGS. 1 to 4. FIG. 1 is a perspective view showing the connector of the first embodiment. FIG. 2 is a cross-sectional view taken along the line A-A of FIG. 1. FIG. 3 is a cross-sectional, perspective view taken along the line A-A of FIG. 1. In FIG. 3, the showing of a wire (cable) and an inner terminal connected to a core wire of the wire is omitted. FIG. 4 is a perspective view showing a conducting member of the connector of FIG. 2.

The connector 1 shown in FIGS. 1 to 3 is for use with a wire harness for installation on an automobile or the like, and this connector 1 comprises a ground terminal 3 (corresponding to a terminal in the claimed invention) connected to an end portion of the coaxial cable 2 (corresponding to a wire in the claimed invention), a synthetic resin-made housing 4 receiving the ground terminal 3 therein, and an earth plate 5 (corresponding to a conducting member in the claimed invention) for connecting the ground terminal to a mating member (not shown) of a conductive nature provided outside the housing 4.

The coaxial cable 2 is a wire for transferring a high-frequency signal, and comprises the core wire (or conductor) 21 for transferring the high-frequency signal, an insulative coating layer 22 covering the core wire 21, a braid shield 23 covering the insulative coating layer 22 so as to prevent noise from appearing on the core wire 21, and a sheath 24 covering the braid shield 23.

The sheath 24 is removed from an end portion of the coaxial cable 2, so that the braid shield 23 is exposed at this end portion of the coaxial cable 2. The ground terminal 3 (described later) is connected to the exposed portion of the braid shield 23. The inner terminal 25 of the male type is connected to an end portion of the core wire 21 disposed within the ground terminal 3. This inner terminal 25 is fitted into a female terminal of a mating connector (not shown) so as to transfer the high-frequency signal to this female terminal-side. In the invention, the inner terminal 25 may be of the female type.

The ground terminal 3 is formed by pressing an electrically-conductive metal sheet into a predetermined shape. The ground terminal 3 includes a tubular portion 32 for receiving the inner terminal 25 therein, and a pair of press-clamping piece portions 31 formed adjacent to a rear end of the tubular portion 32.

The tubular portion 32 has the inner terminal 25 located therein, and therefore electrically shields this inner terminal 25. Namely, the tubular portion 32 prevents noise from appearing on the inner terminal 25. The tubular portion 32 has an opening (or hole) formed through its peripheral wall (outer wall). A terminal retaining/connecting portion 51 (described later) of the earth plate 5 is engaged in this opening 33. By thus engaging the terminal retaining/connecting portion 51 in the opening 33, the ground terminal 3 is retained within the housing 4.

The pair of press-clamping piece portions 31 are wound on the outer periphery of the coaxial cable 2, and more specifically is press-clamped to the exposed portion of the braid shield 23 to be electrically connected thereto. Namely, the ground terminal 3 electrically connects the braid shield 23 to the earth plate 5 so as to flow noise, appearing on the braid shield 23, to the earth plate 5.

The housing 4 is made of an insulative synthetic resin, and is formed into a square tubular (hollow) shape defined by a plurality of outer walls 41, 42, 43 and 44 as shown in FIG. 1. The ground terminal 3 is inserted into the housing 4 through one open end thereof. The mating connector is inserted into the housing 4 through the other open end thereof. A convex portion 45*a* is formed on an inner surface of the outer wall 43 of the housing 4, and also a convex portion 45*b* is formed on an outer surface of the outer wall 43. Retaining holes 53*a* and 53*b* (described later) formed in the earth plate 5 are fitted on these convex portions 45*a* and 45*b*, respectively.

As shown in FIG. 4, the earth plate 5 is formed by pressing a single electrically-conductive metal sheet into a predetermined shape. The earth plate 5 includes a housing retaining portion 52 for being retainingly mounted on the housing 4, the terminal retaining/connecting portion 51 (corresponding to a first connecting portion in the claimed invention) for being engaged in the opening 33 of the ground terminal 3 to retain the ground terminal 3 within the housing 4 and also to be electrically connected to the ground terminal 3, and a grounding portion 54 (corresponding to a second connecting portion in the claimed invention) for electrical connection to the mating member.

More specifically, the strip-like blanked-out metal sheet for forming the earth plate 5 is bent at its central portion into a U-shape to form the housing retaining portion 52. Then, opposite end portions of the strip-like metal sheet are bent several times to form the terminal retaining/connecting portion 51 and the grounding portion 54, respectively.

Namely, the housing retaining portion 52 (defined by the central portion of the strip-like metal sheet bent into the U-shape as described above) includes a pair of parallel spaced, opposed plate-like (flat plate-like) portions 52*a* and 52*b*, and the retaining holes 53*a* and 53*b* formed respectively through the plate-like portions 52*a* and 52*b*. The earth plate 5 is pushed into the housing 4 from the one open end thereof in a longitudinal direction thereof in such a manner that the pair of plate-like portions 52*a* and 52*b* hold (or grip) the outer wall 43 of the housing 4 therebetween, and in this manner the earth plate 5 is mounted on the housing 4.

The terminal retaining/connecting portion 51 is located within the housing 4, and cooperates with an inner surface of the housing 4 to hold the ground terminal 3 therebetween. The terminal retaining/connecting portion 51 is bent into an upwardly protruding shape (when viewed from the side) to provide a spring portion 51*a* which can be resiliently deformed. An apex portion of this spring portion 51*a* intrudes into the opening 33 of the ground terminal 3, and that portion 51*b* of the spring portion 51*a* near to the apex portion resiliently contacts an edge of the opening 33. Namely, the spring portion 51*a* is engaged in the opening 33. Thus, the terminal retaining/connecting portion 51 cooperates with the inner surface of the housing 4 to hold the ground terminal 3 therebetween, and the spring portion 51*a* is engaged in the opening 33 to hold the ground terminal 3 within the housing 4 and also to be electrically connected to the ground terminal 3.

The grounding portion 54 is located at the outside of the housing 4, and is bent into a upwardly protruding shape (when viewed from the side) to provide a spring portion 54*a* which can be resiliently deformed. An apex portion of this spring portion 54*a* resiliently contacts the mating member. As a result, the earth plate 5 is electrically connected to the mating member. Namely, the earth plate 5 electrically connects the braid shield 23 of the coaxial cable 2 to the mating member via the earth plate 5 for grounding purposes so as to flow noise, appearing on the braid shield 23, to the mating member.

Next, a method of assembling the connector 1 of the above construction will be described. First, the sheath 24 and the insulative coating layer 22 are removed from the end portion of the coaxial cable 2, and the inner terminal 25 is secured to an exposed end portion of the core wire 21. Then, the press-clamping piece portions 31 are press-clamped to the outer periphery of the braid shield 23, thereby fixedly securing the ground terminal 3 to the end portion of the coaxial cable 2.

Alternatively, the earth plate 5 is beforehand mounted on the housing 4. For mounting the earth plate 5 on the housing 4, the earth plate 5 is pushed into the housing 4 from the one open end thereof in such a manner that the pair of plate-like portion 52*a* and 52*b* holds the outer wall 43 therebetween, and the retaining holes 53*a* and 53*b* are fitted respectively on the convex portions 45*a* and 45*b*, thus mounting the earth plate 5 on the housing 4.

Then, the ground terminal 3 fixedly connected to the end portion of the coaxial cable 2 is inserted into the housing 4 (having the earth plate 5 mounted thereon) from the one open end thereof. As a result, the spring portion 51*a* of the earth plate 5 intrudes into the opening 33 of the ground terminal 3, so that the ground terminal 3 is held within the housing 4, and also the ground terminal 3 is electrically connected to the earth plate 5. In this manner, the connector 1 is assembled.

The thus assembled connector 1 is mounted on a predetermined portion such that the spring member 54*a* of the earth plate 5 contacts the mating member. Then, the connector 1 is connected to the mating connector so as to flow the high-frequency signal to the mating connector-side and also to flow noise to the mating member-side.

In this embodiment, the ground terminal 3 can be connected to the mating member by using only the earth plate 5, that is, without using a threaded element, a screw and a spring, and therefore there can be provided the connector 1 which has the noise elimination function and the reduced number of component parts and is compact in size.

An ordinary connector has such a structure that a terminal (such as one similar to the ground terminal 3) is retained by a lance formed within a housing, and therefore is held within the housing. In the present invention, however, the terminal retaining/connecting portion 51 has the function of the above lance for holding the ground terminal 3 within the housing 4. This terminal retaining/connecting portion 51 is made of metal which is higher in strength than a synthetic resin, and therefore is less liable to be shaved and plastically deformed, and therefore the terminal retaining/connecting portion 51, while positively holding the ground terminal 3, can be electrically connected to this ground terminal 3.

Furthermore, the spring portions 51*a* and 54*a* are provided at the earth plate 5, and therefore the ground terminal 3 and the earth plate 5 can be connected together with a high contact pressure, and also the earth plate 5 and the mating member can be connected together with a high contact pressure. Therefore, the connecting reliability of the connector 1 can be enhanced by using only the earth plate 5 without using any other part such as a spring.

Furthermore, the housing retaining portion 52 is defined by the intermediate (or central) portion of the strip-like metal sheet bent into the U-shape, and includes the pair of parallel opposed plate-like portions 52*a* and 52*b* for firmly holding the outer wall 43 therebetween, and the retaining holes 53*a* and 53*b* formed respectively through the plate-like portions 52*a* and 52*b* so as to fit respectively on the convex portions 45*a* and 45*b*. Therefore, the earth plate 5 can be easily mounted on the housing 4 without using a jig or a screw.

Second Embodiment

Figure 5:
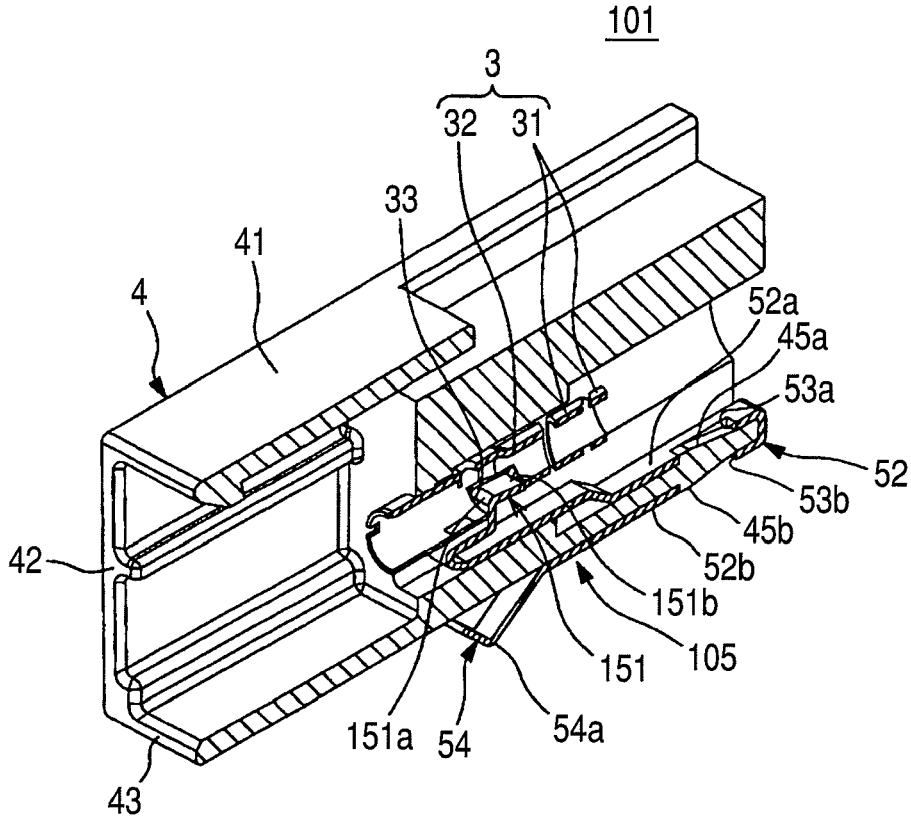
FIG. 5 is a cross-sectional, perspective view showing a second embodiment of a connector of the invention.
Figure 6:
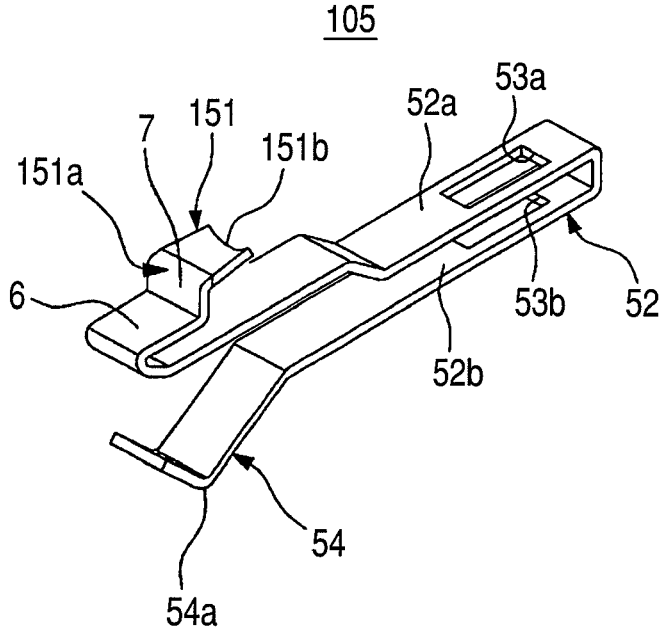
FIG. 6 is a perspective view showing a conducting member of the connector of FIG. 5.
Figure 7:
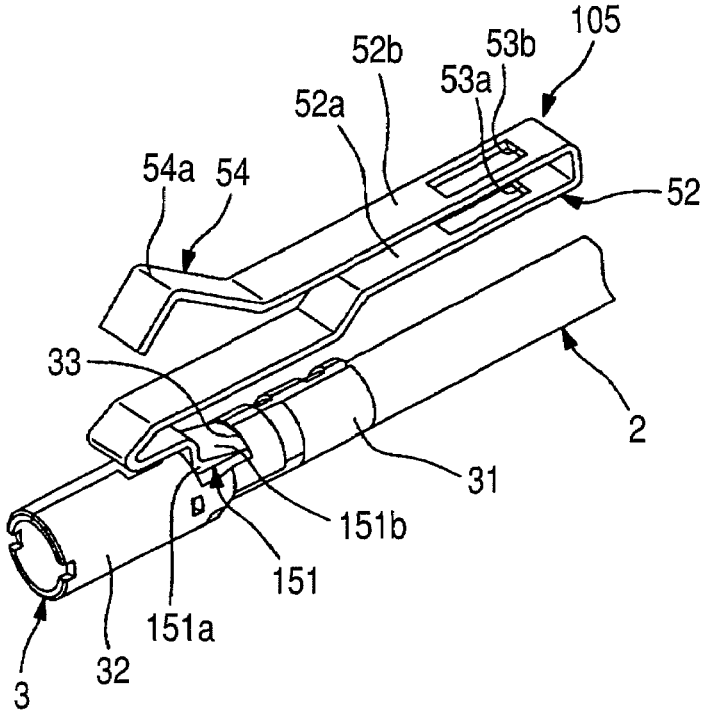
FIG. 7 is a perspective view showing a condition in which the conducting member and a terminal of the connector of FIG. 5 are connected together.
Figure 8:
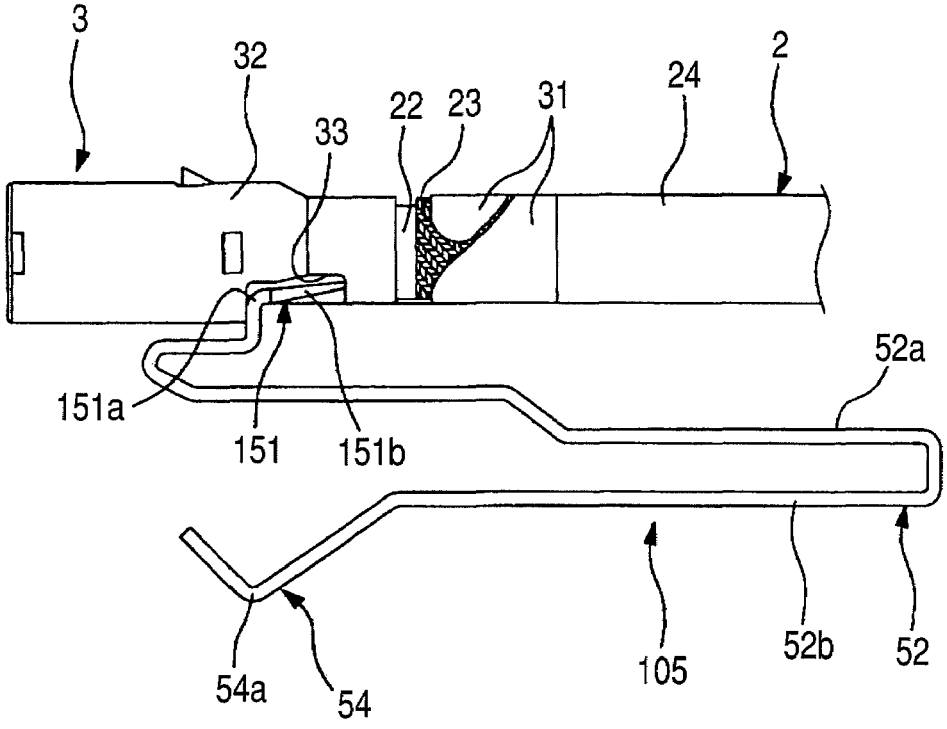
FIG. 8 is a plan view showing the condition in which the conducting member and the terminal of the connector of FIG. 5 are connected together.

Next, a second embodiment of a connector of the invention will be described with reference to FIGS. 5 to 8. FIG. 5 is a cross-sectional, perspective view showing the connector of this second embodiment. In FIG. 5, the showing of a wire (cable) and an inner terminal connected to a core wire of the wire is omitted. FIG. 6 is a perspective view of a conducting member of the connector of FIG. 5. FIG. 7 is a perspective view showing a condition in which the conducting member and a terminal of the connector of FIG. 5 are connected together. FIG. 8 is a plan view showing the condition in which the conducting member and the terminal of the connector of FIG. 5 are connected together. In FIGS. 5 to 8, those portions identical in construction to those of the above first embodiment will be designated by identical reference numerals, respectively, and detailed description thereof will be omitted.

As shown in FIG. 5, the connector 101 of this embodiment comprises the ground terminal 3, a housing 4, and an earth plate 105. As shown in FIG. 6, the earth plate 105 includes a housing retaining portion 52, a terminal retaining/connecting portion 151 (corresponding to the first connecting portion in the claimed invention) for being engaged in an opening 33 of the ground terminal 3 to retain the ground terminal 3 within the housing and also to be electrically connected to the ground terminal 3, and a grounding portion 54.

The terminal retaining/connecting portion 151 is located within the housing 4, and cooperates with an inner surface of the housing 4 to hold the ground terminal 3 therebetween. This terminal retaining/connecting portion 151 includes an engagement portion 151*a* for being engaged with an edge portion of the opening 33 of the ground terminal 3, and a closure portion 151*b* for closing the opening 33. More specifically, the engagement portion 151*a* is that portion of an end portion of a strip-like metal sheet (forming the terminal retaining/connecting portion 151) which is bent at right angles into a generally L-shape, and this engagement portion 151*a* is defined by a portion 6 disposed outside the opening 33 in parallel relation to a peripheral wall of the ground terminal 3 (having the opening 33 therein) and a portion 7 disposed perpendicularly to the peripheral wall (having the opening 33 therein) to be engaged with the edge portion of the opening 33 (see FIG. 6). The closure portion 151*b* is that portion of the end portion of the metal sheet which extends from the engagement portion 151 to the distal end thereof and is bent at right angles relative to the portion 7 of the engagement portion 151*a* for engagement with the edge portion of the opening 33.

The closure portion 151*b* is identical in shape to the opening 33, and is equal in size to the opening 33. The closure portion 151*b* is formed into a curved surface-shape corresponding to the shape of the peripheral wall of a tubular portion 32 of the ground terminal 3.

The terminal retaining/connecting portion 151 of the above construction cooperates with the inner surface of the housing 4 to hold the ground terminal 3 therebetween, and the engagement portion 151*a* is engaged with the edge portion of the opening 33 to hold the ground terminal 3 within the housing 4 and also to be electrically connected to the ground terminal 3. The closure portion 151*b* closes the opening 33, thereby matching the impedance of the ground terminal 3, and also noise is prevented from intruding into the tubular portion 32 through the opening 33.

In this embodiment, even when the impedance of that portion of the ground terminal 3 in which the opening 33 is formed is higher than the impedance of the other portion, the impedance of this portion (having the opening 33) can be made equal to the impedance of the other portion by closing the opening 33 by the closure portion 151*b*. In addition, noise is prevented from intruding into the coaxial cable 2 through the opening 33. Therefore, there can be provided the connector 101 having good high-frequency characteristics.

In the above first and second embodiments, the terminal is the ground terminal 3 connected to the braid shield 23 of the coaxial cable 2, and the conducting member is the earth plate 5, 105 electrically connecting the braid shield 23 to the mating member via the ground terminal 3. However, the present invention can be applied to a connector not provided with the noise elimination function, in which a terminal connected to an end portion of a wire and received within a housing is connected via a conducting member to a mating member (such as a printed circuit board) provided outside the housing.

The opening 33 in the ground terminal 3 does not always need to be the hole formed through the peripheral wall of the tubular portion 32, but may be in the form of a channel-shaped groove or recess.

The above embodiments merely show typical examples of the invention, and the invention is not limited to the above embodiments, and various modifications can be made without departing from the subject matter of the invention.

What is claimed is:

1. A conducting member for connecting a terminal received within a housing of a connector to a mating member of a conductive nature provided outside said housing;

wherein said conducting member is formed by pressing a single metal sheet into a predetermined shape, and includes a housing retaining portion for being retainingly mounted on said housing, a first connecting portion for being engaged with said terminal to retain said terminal within said housing and also to be electrically connected to said terminal, and a second connecting portion for electrical connection to said mating member.

2. A conducting member according to claim 1, wherein at least one of said first connecting portion and said second connecting portion is bent into an upwardly protruding shape to provide a spring portion for resiliently contacting said terminal or said mating member.

3. A conducting member according to claim 1, wherein said metal sheet is bent into a U-shape to provide said housing retaining portion, and said housing retaining portion includes a pair of opposed plate-like portions for holding an outer wall of said housing therebetween, and retaining holes formed respectively in said pair of plate-like portions and adapted to be fitted respectively on convex portions formed on said outer wall.

4. A conducting member according to claim 1, wherein said first connecting portion includes an engagement portion for being engaged with an edge portion of an opening formed through an outer wall of said terminal, and a closure portion for closing said opening.

5. A connector comprising a terminal connected to an end portion of a wire, a synthetic resin-made housing receiving said terminal therein, and a conducting member for connecting said terminal to a mating member of a conductive nature provided outside said housing; characterized in that:

said conducting member is a conducting member as defined in claim 1.

6. A connector according to claim 5, wherein said wire is a coaxial cable comprising a core wire, an insulative coating layer covering said core wire, a braid shield covering said insulative coating layer, and a sheath covering said braid shield; and said terminal is a ground terminal connected to said braid shield; and said conducting member is an earth plate for electrically connecting said braid shield to said mating member via said terminal for grounding purposes.

* * * * *